US006809477B2

(12) United States Patent
Soules et al.

(10) Patent No.: US 6,809,477 B2
(45) Date of Patent: Oct. 26, 2004

(54) FLUORESCENT LAMP ELECTRODE FOR INSTANT START CIRCUITS

(75) Inventors: Thomas F. Soules, Richmond Heights, OH (US); Igor V. Lisitsyn, Chagrin Falls, OH (US); Zsolt Buday, Godoll (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/080,070

(22) Filed: Feb. 21, 2002

(65) Prior Publication Data

US 2003/0160554 A1 Aug. 28, 2003

(51) Int. Cl.[7] ..... H01J 17/04; H01J 1/16

(52) U.S. Cl. ..... 313/631; 313/344; 313/346 R; 445/51

(58) Field of Search ..... 313/574, 631, 313/271–273, 343–346 R, 318.06; 445/50–52

(56) References Cited

U.S. PATENT DOCUMENTS 2,306,925 A 12/1942 Aicher
3,003,077 A * 10/1961 Thomas ..... 313/343
4,680,505 A * 7/1987 Funada et al. ..... 313/558
5,079,478 A * 1/1992 Ikeda et al. ..... 313/492
5,629,586 A * 5/1997 Yasuda et al. ..... 315/46
5,838,100 A 11/1998 Jansma
5,864,209 A * 1/1999 Clark ..... 313/622
6,049,164 A * 4/2000 Van Kemenade et al. .. 313/492
6,465,939 B1 * 10/2002 Ward et al. ..... 313/271

FOREIGN PATENT DOCUMENTS

JP 61288366 A * 12/1986 ..... H01J/61/067

* cited by examiner

*Primary Examiner*—Nimeshkumar D. Patel
*Assistant Examiner*—German Colón
(74) *Attorney, Agent, or Firm*—Fay, Sharpe, Fagan, Minnich & McKee, LLP

(57) ABSTRACT

A fluorescent lamp (10) with improved life is formed by winding a coil (30) using first, second, and third mandrels (45, 46, 50), the third mandrel having a diameter of at least 1.0 mm. The coil is wound around the second mandrel to provide at least 80 turns per inch (TPI). The third mandrel is larger than in conventional coils, allowing about 50% more emitter material (32) than can be loaded on a conventional coil. This has been found to lead to substantially increased lamp life, about 50% longer for a diameter of 1.25 mm than for a coil with diameter of about 0.86 mm. Increasing the TPI of the second coil over that of a coil having a TPI of 60–70 also increases the lamp life by providing better retention of the emitter material. By combining both the increased third diameter with increased second coil TPI, lifetimes of about twice that of a corresponding conventional coil may be achieved.

9 Claims, 4 Drawing Sheets

FLUORESCENT LAMP ELECTRODE FOR INSTANT START CIRCUITS

BACKGROUND OF THE INVENTION

The present invention relates generally to fluorescent lamps and more particularly to a cathode for a low pressure mercury vapor discharge fluorescent lamp for use with an instant start circuit.

Fluorescent lamps, as known, include a glass tube coated on the inside with phosphor powders which fluoresce when excited by ultraviolet light. The glass tube is filled with rare gases (such as argon, neon, and krypton) and a small amount of mercury, and operates at a relatively low pressure. Electrodes are mounted within the glass tube. The electrodes are coated with an emission mixture, typically comprising carbonates of barium, calcium, and strontium. The carbonates are converted to a ceramic material comprising the corresponding oxides when activated. The emitter material emits electrons during lamp operation. The electrons are accelerated by the voltage across the tube until they collide with mercury atoms, causing the mercury atoms to be ionized and excited. When the mercury atoms return to their normal state, photons corresponding to mercury spectral lines in both the visible and ultraviolet region are generated, thereby exciting the phosphor coating on the inside of the tube to luminance. Fluorescent lamps are becoming widely accepted as plug in replacements for incandescent lamps.

To start a fluorescent lamp, electron emission from the electrodes may be induced in several ways. In a first method, a filament electrode is heated by passing current through it. Such lamps may be referred to as "preheat" lamps. During initial start-up of the preheat lamp, a starter bulb, which acts as a switch, is closed, thus shorting the electrodes together. Current passes through both electrodes, serving to preheat the electrodes. This makes them more susceptible to emission of electrons. After a suitable time period has elapsed, during which the electrodes have warmed up, the starter bulb opens. An electric potential is thus applied between the two electrodes, resulting in electron current between them, with subsequent operation of the lamp. A relatively high voltage is applied initially for starting purposes. Then a lower voltage is used during normal operation. A reactance is placed in series with the lamp to absorb any difference between the applied and operating voltages, in order to prevent damage to the lamp. The reactance, suitable transformers, capacitors, and other required starting and operating components are contained within a device known as a ballast.

In a second method of starting, a high voltage, which is sufficient to start an electric discharge in the lamp, is applied across the lamp without preheating the electrodes. So-called "instant start" circuits which are commonly used today typically employ this method of starting. Such instant start lamps employ ballasts which are much more energy efficient than older style ballasts which heat the electrodes. Since a current does not pass through the electrodes, instant-start lamp electrodes may have only a single terminal, although two terminals may be provided so that the lamp may be used with instant start or other ballasts. An extremely high starting voltage (e.g., up to 500–800 V) is typically applied at high frequency in order to induce current flow without preheating of the electrodes. The high starting voltage is supplied by a special instant-start ballast.

A third type of lamp is known as the "rapid-start" lamp. A rapid-start ballast contains transformer windings, which continuously provide an appropriate voltage and current for heating of the electrodes. Heating of electrodes permits relatively fast development of an arc from electrode to electrode using only the applied voltage from the secondary windings present in the ballast.

Due to the cost of the components and the sophisticated enclosed fixtures often used, it is desirable to extend the life of fluorescent lamps to reduce replacement costs. Various ways have been developed to increase life. Ballast designs have been improved to obtain a smoother start of the lamp. High frequency rapid and program start ballasts have been developed which first heat the electrode and then either keep the electrode hot during operation (rapid start) or turn the heater current off (program ballasts). Use of high current or high Rh/Rc rapid start ballasts has been found to increase lamp life.

Changing the gas composition has also been found to improve lamp life. For example, increasing the argon pressure above the standard 2.5 torr has been found to decrease diffusion coefficients of the fluorescent lamp cathode species and hence impedes evaporation of the emitter from the coil. Increasing the fill pressure from 2.5 torr to 2.8 torr, for example, has been found to provide a 20% increase in lamp life. However, efficiency of the lamp decreases as the fill pressure increases. The higher pressures also negatively affect the lamp starting voltage.

Another way to increase lamp life is to increase the proportion of heavy gases, such as Kr and Xe, in the fill. This decreases the evaporation of the cathode emitter species and increases lamp life. However, changing the gas composition also changes the wattage of the lamp and starting characteristics.

Despite improvements, lamps using rapid start ballasts typically have longer life than those on instant start ballasts. For example, a typical T8 SP Starcoat™ lamp manufactured by General Electric Company is rated at a life of 20,000 hours on a rapid start ballast and 15,000 hours on a conventional instant start ballast (so called T8 lamps have an internal diameter of 1". T12 lamps have an internal diameter of 1.5").

Instant start ballasts are generally easier to manufacture than rapid start ballasts. Thus, several current designs of lamps, such as GE's F32T8 Ultra Watt Miser and Ultra Watt Miser XL, are designed for use with instant start ballasts. There remains a need for a lamp which operates with an instant start ballast, but which has a lifetime more comparable to or exceeds that of rapid start ballasts.

SUMMARY OF THE INVENTION

In an exemplary embodiment of the present invention, a discharge lamp is provided. The lamp includes an envelope. A discharge-sustaining fill is sealed inside the envelope. First and second electrodes provide a discharge. At least the first electrode includes a current carrying wire and a coil including a first coiled structure formed by winding an overwind wire around a first cylindrical member, a second coiled structure formed by winding the first coiled structure around a second cylindrical member, a third coiled structure formed by winding the second coiled structure around a third cylindrical member. The third cylindrical member has a diameter of at least 1.0 mm. An emitter material is deposited on the coil.

In another exemplary embodiment of the present invention, a discharge lamp includes an envelope. A discharge-sustaining fill is sealed inside the envelope. First and second electrodes provide a discharge. At least the first electrode includes a coil including a first coiled structure formed by winding a wire around a first cylindrical member, a second coiled structure formed by winding the first coiled structure around a second cylindrical member. The second coiled structure has coils which are spaced to provide at least 80 turns per inch (TPI). A third coiled structure is formed by winding the second coiled structure around a third cylindrical member. An emitter material is deposited on the coil.

In another exemplary embodiment, a method for forming a coil for a fluorescent lamp is provided. The method includes winding a wire around a first cylindrical member and a current carrying wire to form a first coiled structure. The first coiled structure is wound around a second cylindrical member to form a second coiled structure. The second coiled structure is wound around a third cylindrical member to form a third coiled structure. The third structure has a diameter of at least 1 mm. The third coiled structure is coated with an emitter mix which, when activated, emits electrons when a voltage is applied to the coil.

One advantage of at least one embodiment of the present invention is the provision of an electrode with a longer life, thereby increasing the lifetime of a fluorescent lamp in which it is used.

Another advantage of at least one embodiment of the present invention is the provision of a fluorescent lamp for use with an instant start ballast which has a longer useful life.

Still further advantages of the present invention will become apparent to those of ordinary skill in the art upon reading and understanding the following detailed description of the preferred embodiments.

DETAILED DESCRIPTION OF THE INVENTION

Figure 1:
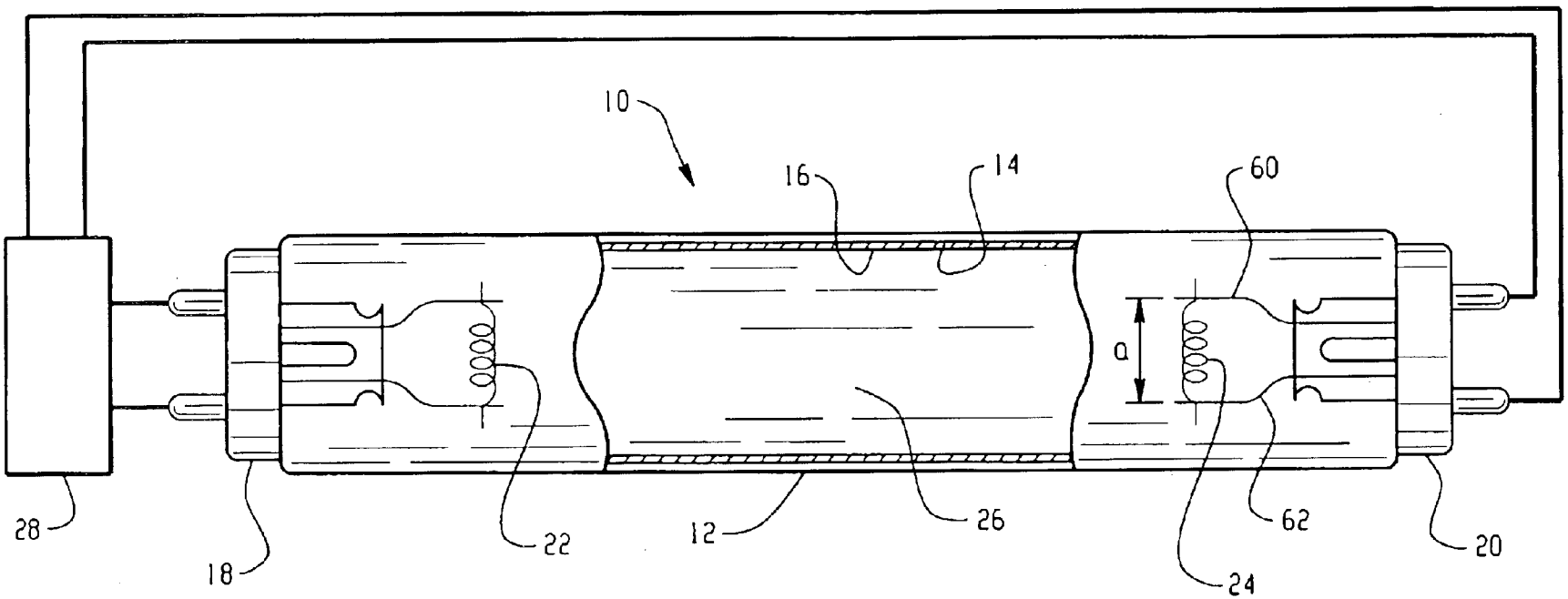
FIG. 1 is a side view in partial section of a lamp according to the present invention.

FIG. 1 shows a representative low pressure mercury vapor discharge fluorescent lamp 10. It will be appreciated that a variety of fluorescent lamps may be used with the present invention, including single or double ended lamps, and curved or straight lamps. The fluorescent lamp 10 has a light-transmissive tube or envelope 12 formed from glass or other suitable material, which has a circular cross-section. An inner surface 14 of the glass envelope is provided with a phosphor-containing layer or layers 16. The lamp is hermetically sealed by bases 18, 20, attached at ends of the tube, respectively. Two spaced electrodes 22, 24 are respectively mounted on the bases 18, 20. A discharge-sustaining fill 26, preferably formed from mercury and an inert gas, is sealed inside the glass tube. The inert gas is typically argon or a mixture of argon and other noble gases at low pressure, which, in combination with a small quantity of mercury, provide the low vapor pressure manner of operation. The lamp is preferably a low pressure mercury vapor discharge lamp, as described, but the invention may also be used in a high pressure mercury vapor discharge lamp.

The phosphor-containing layer or layers 16 typically contain phosphor particles which are known in the art, such as a relatively inexpensive "halo" phosphor which emits a white light, such as a calcium halophosphate activated with antimony and manganese. Rare earth phosphor systems may also be used. These phosphor systems are typically a blend of rare earth phosphors, such as a mixture of red, blue, and green color-emitting phosphors.

The lamp is fitted with an instant start ballast 28. As is known in the art, the instant start ballast may include electronic circuitry designed to produce a high voltage pulse "instantly" (at around 40 KHz) between the electrodes at a sufficient voltage to cause breakdown of the fill and initiate an arc. While an instant start ballast is preferred, it is also contemplated that other types of ballast may be employed with the present lamp, in which case the life of the lamp would be similarly increased by the present invention.

With reference now to FIGS. 2–5, the electrodes each include a coil 30, which is coated with an emitter material 32. The electrodes are preferable similarly formed. As the lamp is used in an alternating circuit, the electrodes alternate in polarity, each one successively becoming the cathode. The emitter material is preferably formed from one or more carbonates of Group II elements, such as calcium, strontium, and barium carbonates. A preferred emitter material comprises a mixture of each of these three carbonates. When activated, the carbonates form a ceramic of the corresponding oxides, barium oxide, strontium oxide, and calcium oxide in the preferred embodiment.

For example, to make the coprecipitated carbonate emitter material, a solution of Ba, Sr, and Ca ions is prepared by dissolving the corresponding nitrates or other salts in hot, deionized water. The solution is stirred in a steam jacketed reactor. The carbonates are precipitated by slowly adding an excess of ammonium carbonate or other soluble carbonate salt or by bubbling carbon dioxide through the reactor solution. The result is a precipitate of Ba, Sr, and Ca carbonates. Typical overall compositions are 40–70 wt % equivalent barium carbonate, 30–50 wt % equivalent strontium carbonate and 10–20 wt % equivalent calcium carbonate. There may be several post precipitation processes designed to help form the carbonate precipitate and to concentrate and then remove water from the precipitate. A small amount, e.g., 2–5 wt % zirconium carbonate, may also be precipitated by adding a soluble zirconium salt to the solution before precipitation. In another embodiment, zirconia (zirconium oxide) or zirconium metal is added later. Typically, the coprecipiated carbonate powder after it is dried has a median particle size of 15–25 micrometers. The particles are highly agglomerated.

In order to make a slurry which will be used to coat the fluorescent lamp coils, the mixed carbonate powder is combined with a liquid medium. The liquid medium may be similar to that used in laquers and consists of an organic solvent, such as butyl acetate, or other low molecular weight acetate, and nitrocellulose, which is used as a thickener and binder. Other ingredients, such as alcohol, may also be added to achieve the desired viscosity. For example, a relatively small amount of the liquid medium is added to a ball mill containing alumina or zirconia milling media. The powder is then added to the ball mill. A slurry suitable for application to the coils is 40–65 wt %, more preferably, about 60 wt %, carbonate powder.

The carbonate powder may be added to the mill all at once or in stages, running the mill in between additions. For example, half of the desired amount of powder can be added to the liquid and milling media followed by a short running of the mill before the rest of the powder is added. This makes it easier to wet the powder during milling. After all the powder has been added to the mill, the ball mill is run for several of hours, generally about 5,000 to 20,000 revolutions, until the desired particle size is achieved. The median particle size is selected based on a number of criteria, including ability to coat the coils, lamp life, and absence of end-discoloration on the lamp. A median particle size of between 2.5–6 micrometers is preferred, more preferably, 3–5 micrometers, as measured on a granulometer. 2–5 wt % zirconia or zirconium metal may be added at any time during or after the milling. The slurry may be stored until needed.

It has now been found that in conventional fluorescent lamps, the ceramic material tends to fracture and break apart over time. Without intending to limit the scope of the invention, it is proposed that such failure may be due to the lamp being subjected to repeated thermal shock and thermal mismatch stresses associated with the heating of the coil during lamp starting. Mechanical stresses may also contribute to failure. Pieces of the emitter material eventually fall off the electrodes, resulting in eventual failure of the lamp. An investigation of the fracture and break up of the ceramic material in a conventional T8 lamp using scanning electron microscopy (SEM) revealed the rapid deterioration of the emitter material towards the end of the lamp life. The weight of emission material was also found to drop relatively slowly during the first two thirds of the lamp life, followed by a significantly faster drop thereafter. Another cause of reduced lifetime is due to the loss of emitter material due to evaporation and sputtering.

Figure 4:
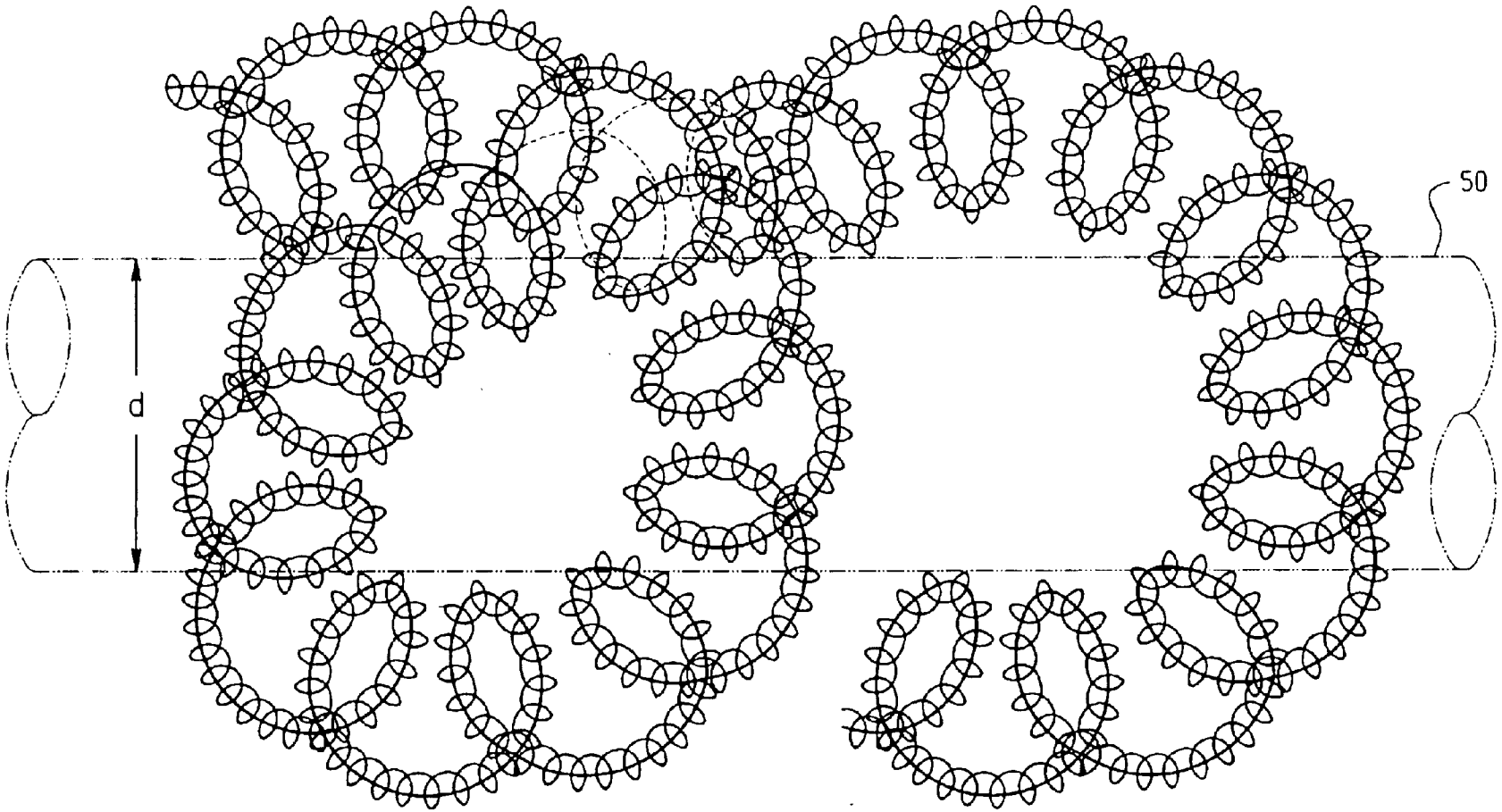
FIG. 4 is a perspective view of the secondary coil wound to produce a tertiary coil.
Figure 5:
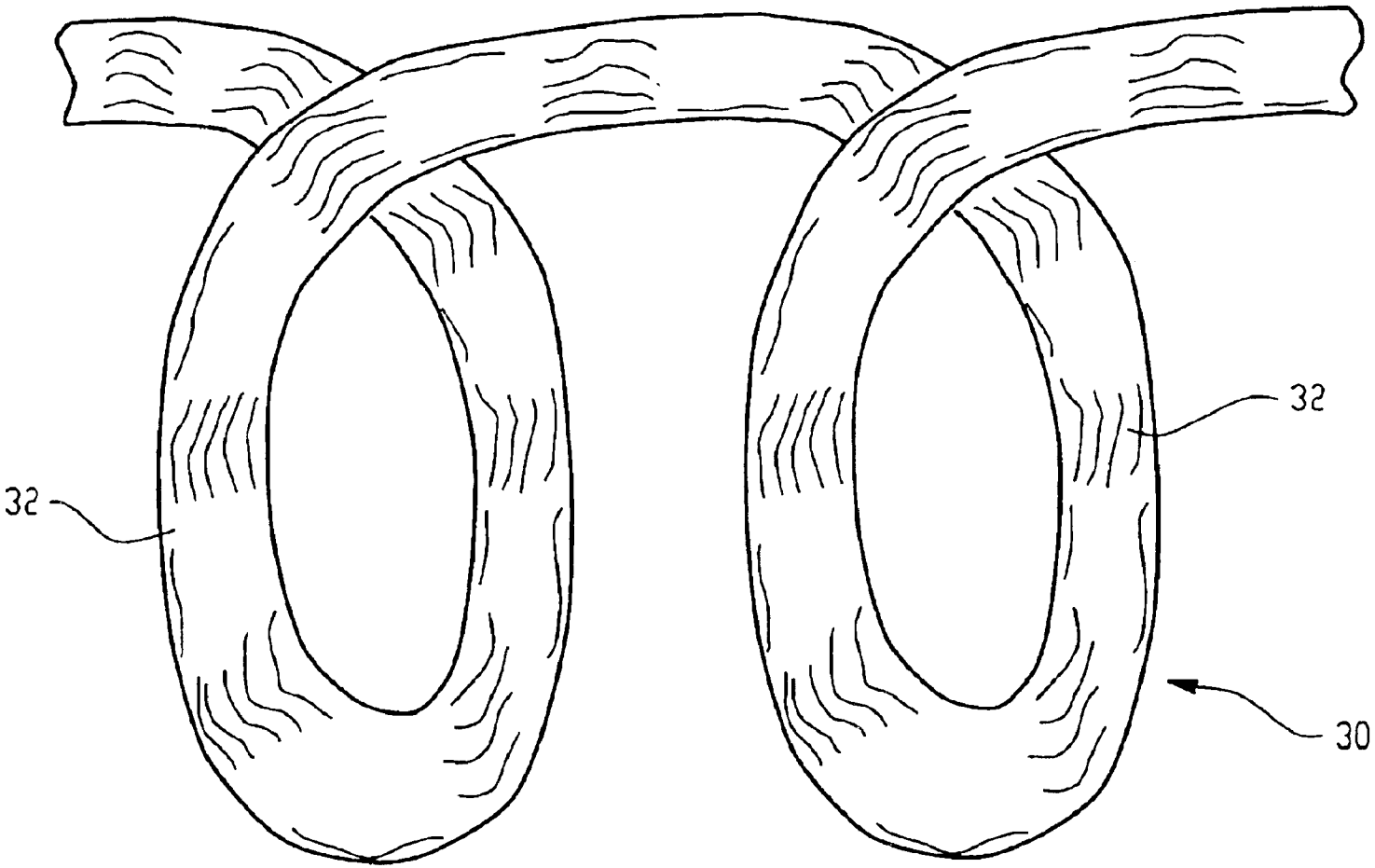
FIG. 5 is a perspective view of the tertiary coil of FIG. 4 coated with an emitter material.

To address these problems and provide for longer lamp life, the present electrode has a larger amount of emitter material than in conventional lamps. As shown in FIG. 4, the coil has a primary, a secondary, and a tertiary coil structure, each of the secondary and tertiary coils being formed by winding the previous coil. Preferably, the lamp has about 50% more emitter than in a conventional lamp due primarily to the increased diameter of the tertiary mandrel and the longer length of the coil. For example, conventional coils used in T8 lamps usually have about 7–8 mg of emitter on a coil which is about 11.5 mm in overall length. The present coil may have 9–16 mg for a coil that has an overall length $\alpha$ of about 11.5 mm (see FIG. 1). The amount of emitter material which can be supported is dependent on the length of the secondary coil (i.e., the length of the coil before winding to produce the tertiary coil structure). If too much emitter is added, the material fills the gaps (bridging) between the tertiary coils. As a result, the material is not readily activated. The life of the lamp is dependent on the amount of emitter material. It has been found that there is an approximately linear relationship between amount of emitter and lamp life. Thus, it is desirable to achieve the maximum loading of emitter material which can be activated effectively.

Figure 2:
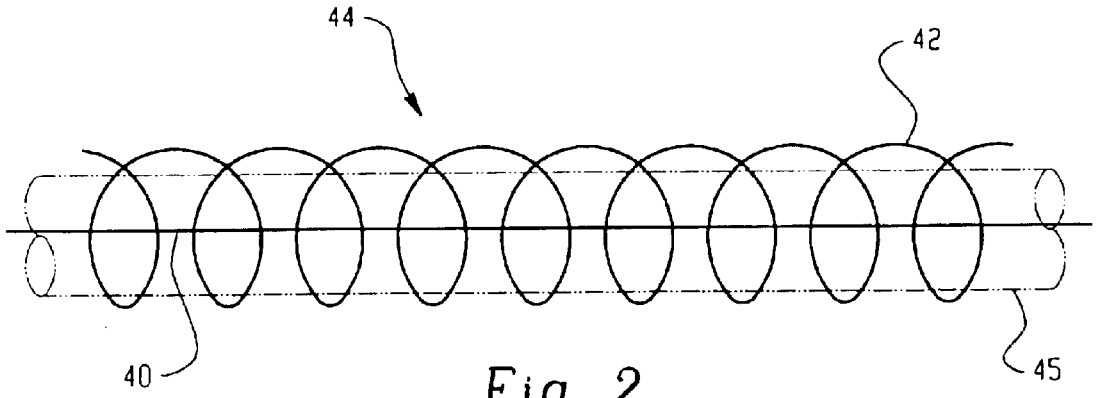
FIG. 2 is a perspective view of a primary coil and current carrying wire for the lamp of FIG. 1.
Figure 3:
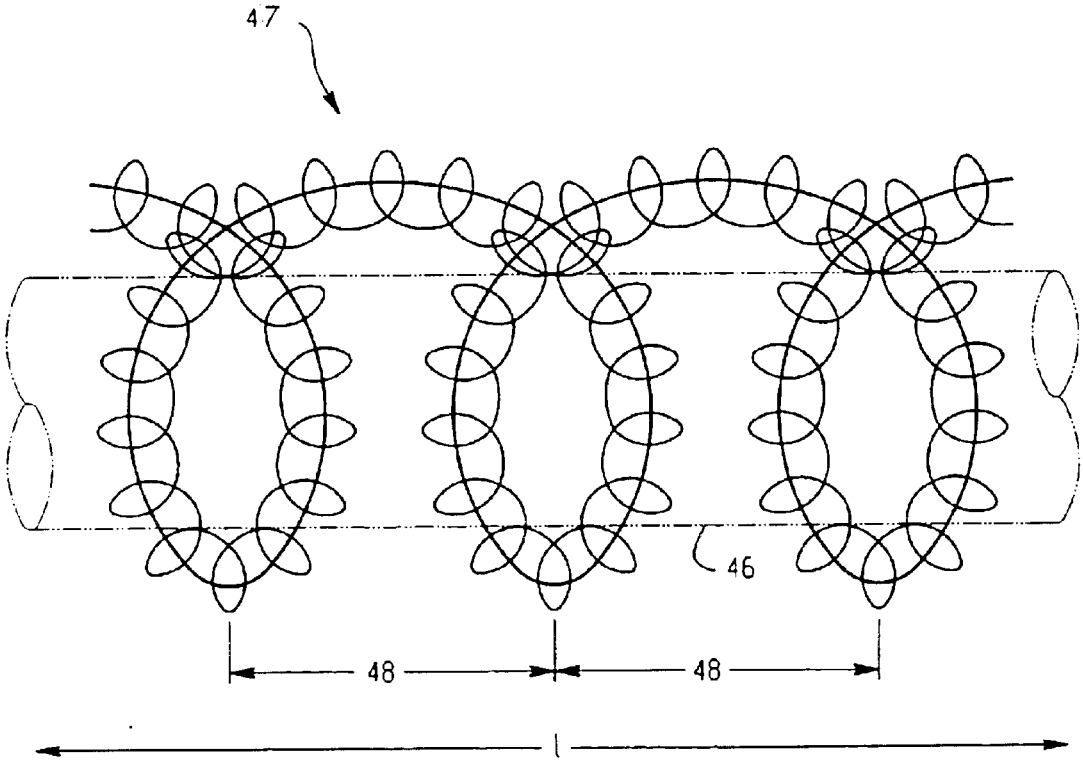
FIG. 3 is a perspective view of the primary coil of FIG. 2, wound to produce a secondary coil.

The electrodes preferably have a triple coil geometry as shown in FIG. 4. The coil 30 includes a current carrying wire 40, which is preferably 1.5 to 3 mills (38–76 microns) in diameter and about 100–150 mm in length, more preferably, about 130–140 mm in length. An overwind wire 42 is coiled around the current carrying wire 40 to form a primary coil 44, as shown in FIG. 2. A first generally cylindrical member such as a mandrel 45 (shown in phantom) is used to determine the width of each turn of the coil. Thus, the overwind wire is wound around both the mandrel and the current carrying wire. The primary coil (together with the mandrel 45 and current carrying wire 40) is then wrapped around a second generally cylindrical member, such as a second mandrel 46 (shown in phantom) to produce a secondary coil 47, as shown in FIG. 3. The secondary coil has a closer spacing 48 between each loop of the coil than is found in conventional cathodes. Preferably, the secondary coil has a spacing 48 which provides from about 80 to about 300 turns per inch (TPI) (30–120 turns per cm). More preferably, the spacing is such as provides at least 85 turns per inch, most preferably 90–200 turns per inch. In practice, the ability to coil effectively without appreciable overlapping of coils may limit the TPI to about 80–130. This is significantly greater than in conventional lamps, where the TPI is about 60. The secondary coil has an overall length 1, when formed, of about 20–40 mm, more preferably about 30 mm.

The secondary coil is then wound around a third cylindrical member, such as a third mandrel 50 to produce the tertiary coil, as shown in FIG. 4. The diameter d of the third mandrel is preferably at least 1 mm, more preferably, 1–2 mm, and most preferably, 1.2 to 1.55 mm. This compares with about 0.8 mm for a conventional cathode. The third mandrel could be larger than 2 mm. However, at some point the coil loses its structural integrity.

The three mandrels are preferably removed, after forming the coiled structure, by dissolving the mandrels away in an acid bath.

As a result of the increased diameter of the third mandrel, the coil length 1 (i.e., the effective length of the secondary coil before winding to form the third coil) is about 50% longer than in a conventional fluorescent lamp. Since the amount of emitter material the coil can support is proportional to the length 1 of the coil, a 50% increase in secondary coil length 1 generally results in about 50% more emitter material and a correspondingly longer tube life (about 50% longer). An increase in TPI has also been found to lead to increased lamp life by holding the emitter material onto the cage-like structure of the coil for a longer period of time. By combining both of these features in the coil, lifetimes of about double current to standard lamp lifetimes may be achieved.

The coil thus formed is coated with a slurry of (Ba, Ca, Sr)$CO_3$ or other suitable emitter slurry, which forms the emitter material when activated. The amount of the triple carbonate material which can be supported on the coil is preferably from 9 to 16 mg (this is for a coil of 10–12 mm in finished length for shorter or longer coils, the amount of emitter material will vary accordingly).

The electrode thus formed is suitable for use as a cathode/anode in fluorescent lamps of from about 1" to 1½ (2.5–3.8 cm) in diameter, such as lamps commonly referred to as T8 and T12. The coil 30 is mounted to the base by first and second electrically conductive supports 60, 62 such that the coil is arranged generally perpendicular to the tube length. The glass tube is preferably coated on the inside with a fine alumina powder which serves as a UV reflecting coating. After drying the alumina coating, the tube is coated with a slurry containing a rare earth phosphor powder blend, halophosphate phosphor blend, or other selected phosphor material. Alternative UV reflecting coatings and phospor coatings are also contemplated.

The electrodes are sealed into ends of the tube and the tube exhausted as is commonly known before being dosed with a small amount of mercury and back filled with the selected inert gas.

The following examples indicate the improvements in lamp life which can be made.

EXAMPLES

Cathode coils for use in T8 lamps were formed with different coil parameters, such as current carrying wire diameter, overwind wire pitch, secondary coil pitch, and tertiary mandrel diameter. All variables were used in a $2^4$ factorial design of experiments to determine which, if any of these parameters, had beneficial results. The results indicate that the most important parameters for determining the emitter mass and the number of starts in a rapid cycle test were the third mandrel diameter and the second mandrel turns per inch (TPI). Emitter mass was determined by weighing samples of the coil with the dried emitter coating and then removing the coating in a vibrating water/acid bath and reweighing.

Rapid cycle tests were performed by turning the lamp on and off either on a 1 minute on, 1 minute off cycle, or a 5-minute on, 5 minute off cycle. Both experiments were done on eight lamps in each cell of the design of experiments. The number of starts before failure was recorded.

Table 1 summarises the expected life increase based on increase in emitter mass and on the number of rapid cycle starts. The table shows the effect of increasing the 2nd mandrel TPI from 68.6 of 89.9 TPI and increasing the 3rd mandrel diameter from 0.86 mm to 1.25 mm diameter. These results are for the 5-minute on, 5 minute off cycle.

TABLE 1

| | Original Mass of Emitter material (mg) | Mass of Emitter material for Change in Coil (mg) | Expected Life Increase Based On Emitter Mass Increase | Original Number of Rapid Cycle Starts | Number of Rapid Cycle Starts for Change in Coil | Expected Life Increase Based On Increase in Rapid Cycle Starts |
|---|---|---|---|---|---|---|
| Longer cathode - increased 3rd mandrel from 0.86 mm to 1.25 mm | 7.5 | 10.5 | ~ +40% | 4000 | 6300 | ~ +60% |
| Tighter cathode - 2nd mandrel TPI increased from 68.6 to 89.9 | 7.5 | 9.0 | ~ +20% | 4000 | 6800 | ~ +70% |
| Longer cathode - increased 3rd mandrel from 0.86 mm to 1.25 mm and tighter cathode - 2nd mandrel TPI increased from 68.6 to 89.9 | 7.5 | 12 | ~ +60 | 4000 | 8800 | ~ +120 |

The 1-minute on/off cycle showed similar results. The results show large and unexpected improvements in lamp life.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A discharge lamp comprising:

an envelope;

a discharge-sustaining fill sealed inside the envelope;

first and second electrodes for providing a discharge, at Least the fist electrode including a current carrying wire and a coil including:

a first coiled structure formed by winding an overwind wire around a first cylindrical member.

a second coiled structure formed by winding the first coiled structure around a second cylindrical member without appreciable overlapping of the coils, the second coiled structure having at least 80 turns per inch, a third coiled structure formed by winding the second coiled structure around a third cylindrical member, the third cylindrical member having a diameter least 1.2 mm, and an emitter material deposited on the coil, the amount of emitter material being at least 9–16 mg per 11.5 mm length of the coil.

2. The discharge lamp of claim 1, wherein the third cylindrical member has a diameter of at least 1.2–1.5 mm.

3. The discharge lamp of claim 1, wherein the second coiled structure has at least 85 turns per inch.

4. The discharge lamp of claim 1, wherein the third coiled structure is at least 10 mm in length.

5. The discharge lamp of claim 4, wherein the third coiled structure is 11–12 mm in length and the lamp is a T8 lamp.

6. The discharge lamp of claim 1, wherein the emitter material comprise an oxide selected from the group consisting of barium, strontium, calcium, zirconium.

7. The discharge lamp of claim 1, wherein the second coiled structure has at least 90 turns per inch.

8. The discharge lamp of claim 1, wherein the secondary coil is about 30 mm in length.

9. A method for forming a coil for a fluorescent lamp, the method comprising:

winding a wire around a first cylindrical member and a current carrying wire to form a first coiled structure;

winding the first coiled structure around a second cylindrical member, without appreciable overlapping of coils, to form a second coiled structure having 80–130 turns per inch; and winding the second coiled structure around a third cylindrical member, the third cylindrical member having a diameter of 1.2–1.5 mm, to form a third coiled structure; and coating the third coiled structure with an emitter mix which, when activated, emits electrons when heated, the amount of emitter material being 10–15 mg/30 mm length of secondary coil.

* * * * *

UNITED STATES PATENT AND TRADEMARK OFFICE

CERTIFICATE OF CORRECTION

PATENT NO. : 6,809,477 B2
DATED : October 26, 2004
INVENTOR(S) : Soules et al.

It is certified that error appears in the above-identified patent and that said Letters Patent is hereby corrected as shown below:

Column 8,
Line 60, claim 6 should read as follows:
6. The discharge lamp of claim 1, wherein the emitter material comprise an oxide selected from the group consisting of barium, strontiu, calciu, zirconium and combinations thereof.

Signed and Sealed this

Nineteenth Day of April, 2005

JON W. DUDAS
*Director of the United States Patent and Trademark Office*